US009796465B2

(12) United States Patent
Kataoka

(10) Patent No.: US 9,796,465 B2
(45) Date of Patent: Oct. 24, 2017

(54) IDENTIFICATION NUMBER SETTING APPARATUS AND IDENTIFICATION NUMBER SETTING METHOD OF OUTBOARD MOTORS

(71) Applicant: SUZUKI MOTOR CORPORATION, Hamamatsu-shi, Shizuoka (JP)

(72) Inventor: Toshiya Kataoka, Hamamatsu (JP)

(73) Assignee: SUZUKI MOTOR CORPORATION, Hamamatsu-Shi (JP)

( * ) Notice: Subject to any disclaimer, the term of this patent is extended or adjusted under 35 U.S.C. 154(b) by 0 days.

(21) Appl. No.: 14/731,000

(22) Filed: Jun. 4, 2015

(65) Prior Publication Data

US 2015/0355636 A1 Dec. 10, 2015

(30) Foreign Application Priority Data

Jun. 6, 2014 (JP) ..... 2014-117539

(51) Int. Cl.
*B63H 21/21* (2006.01)
*B63H 20/00* (2006.01)
*G07C 9/00* (2006.01)

(52) U.S. Cl.
CPC ..... *B63H 20/00* (2013.01); *G07C 9/00896* (2013.01); *G07C 2009/00841* (2013.01)

(58) Field of Classification Search
CPC ..... B63H 2020/003; B63H 21/21
USPC ..... 340/5.1; 440/84
See application file for complete search history.

(56) References Cited

U.S. PATENT DOCUMENTS

| | | | | |
|---|---|---|---|---|
| 6,997,764 | B2 | 2/2006 | Okuyama et al. | 440/2 |
| 2005/0118896 | A1 | 6/2005 | Okuyama et al. | 440/2 |
| 2008/0020656 | A1* | 1/2008 | Yamada | B63H 20/00 440/1 |
| 2010/0048068 | A1* | 2/2010 | Bamba | B63H 21/17 440/1 |
| 2011/0136398 | A1* | 6/2011 | Takeda | B63J 99/00 440/1 |

FOREIGN PATENT DOCUMENTS

JP 4326924 B2 9/2009

* cited by examiner

*Primary Examiner* — Kevin Kim
(74) *Attorney, Agent, or Firm* — Stein IP, LLC

(57) ABSTRACT

There is provided an identification number setting apparatus of a plurality of outboard motors attached to a ship body. A plurality of engine control modules are provided in the plurality of outboard motors. A keyless controller is configured to perform an authentication process for keyless control between the keyless controller and the plurality of engine control modules. During initial registration of authentication information for the authentication process, the keyless controller sets identification numbers in the plurality of engine control modules.

6 Claims, 3 Drawing Sheets

IDENTIFICATION NUMBER SETTING APPARATUS AND IDENTIFICATION NUMBER SETTING METHOD OF OUTBOARD MOTORS

CROSS-REFERENCE TO RELATED APPLICATIONS

The disclosure of Japanese Patent Application No. 2014-117539 filed on Jun. 6, 2014, including specification, drawings and claims is incorporated herein by reference in its entirety.

TECHNICAL FIELD

The present invention relates to an identification number setting apparatus and an identification number setting method of outboard motors, and particularly, to an identification number setting apparatus and an identification number setting method of a plurality of outboard motors which is attached to the body of a ship.

BACKGROUND

In a ship equipped with a plurality of outboard motors, in order to appropriately control individual engines included in the outboard motors, it is necessary to identify the individual outboard motors. In order to appropriately identify a plurality of outboard motors, there has been proposed a ship having an identification number setting system in which an engine control module (ECM) of an outboard motor first attached sets identification numbers between the first outboard motor and the other outboard motors subsequently attached (see Patent Document 1 for instance).

Patent Document 1: Japanese Patent No. 4326924

However, in an identification number setting system which is disclosed in Patent Document 1 and is as described above, the ECM of each outboard motor needs to have a function of setting identification numbers between the corresponding outboard motor and other outboard motors (an identification number setting function). To this end, it is necessary to execute a control program for realizing the identification number setting function by an ECM. Therefore, there is a problem that control of ECMs is complicated.

SUMMARY

It is an object of the present invention to provide an identification number setting apparatus and an identification number setting method of outboard motors which can set identification numbers in a plurality of outboard motors without requiring complicated control of engine control modules (ECMs) even in a case where the plurality of outboard motors is attached to the body of a ship.

According to an aspect of the embodiments of the present invention, there is provided an identification number setting apparatus of a plurality of outboard motors attached to a ship body, including: a plurality of engine control modules provided in the plurality of outboard motors; and a keyless controller configured to perform an authentication process for keyless control between the keyless controller and the plurality of engine control modules, wherein during initial registration of authentication information for the authentication process, the keyless controller sets identification numbers in the plurality of engine control modules.

According to this configuration, the keyless controller which performs the authentication process for the keyless control between the keyless controller and the plurality of engine control modules sets the identification numbers in the plurality of engine control modules during the initial registration of the authentication information. Therefore, it is possible to practically omit control of the engine control modules for setting the identification numbers. As a result, even in a case where a plurality of outboard motors is attached to the ship body, it becomes possible to set the identification numbers in the individual outboard motors without requiring complicated control of engine control modules.

In the identification number setting apparatus, it is preferable that the keyless controller sets the identification numbers in the plurality of engine control modules in a predetermined order according to arrangement of the plurality of outboard motors on the ship body. According to this configuration, the identification numbers are set in the plurality of engine control modules in the predetermined order according to the arrangement of the plurality of outboard motors on the ship body. Therefore, it is possible to set the identification numbers according to the positions of the outboard motors on the ship body, in the engine control modules. As a result, it becomes possible to appropriately control the plurality of outboard motors using the position information of the outboard motors according to the identification numbers.

Especially, in the identification number setting apparatus of outboard motors, it is preferable that the keyless controller sets a minimum value different from the identification number of an engine control module previously set, as the identification number of a subsequent engine control module. According to this configuration, it is possible to prevent one number from being set with respect to the engine control modules of the plurality of outboard motors. As a result, it becomes possible to surely prevent situations where it becomes impossible to appropriately control the engine control modules (the outboard motors) due to setting of the same identification number.

According to another aspect of the embodiments of the present invention, there is provided an identification number setting method of a plurality of outboard motors attached to a ship body which includes a plurality of engine control modules and a keyless controller configured to perform an authentication process for keyless control between the keyless controller and the plurality of engine control modules, the identification number setting method including performing initial registration of authentication information for the authentication process by the keyless controller; and setting identification numbers in the plurality of engine control modules during the initial registration.

According to this method, the keyless controller which performs the authentication process for the keyless control between the keyless controller and the plurality of engine control modules sets the identification numbers in the plurality of engine control modules during the initial registration of the authentication information. Therefore, it is possible to practically omit control of the engine control modules for setting identification numbers. As a result, even in a case where a plurality of outboard motors is attached to the body of a ship, it becomes possible to set identification numbers in the individual outboard motors without requiring complicated control of engine control modules.

In the identification number setting method of outboard motors, it is preferable to set the identification numbers in the plurality of engine control modules in a predetermined order according to the arrangement of the plurality of outboard motors on the ship body. In this case, the identification numbers are set in the plurality of engine control modules in the predetermined order according to the arrangement of the plurality of outboard motors on the ship body. Therefore, it is possible to set the identification numbers according to the positions of the outboard motors on the ship body, in the engine control modules. As a result, it becomes possible to appropriately control the plurality of outboard motors using the position information of the outboard motors according to the identification numbers.

Especially, in the identification number setting method of outboard motors, it is preferable to set a minimum value different from the identification number of an engine control module previously set, as the identification number of a subsequent engine control module. In this case, it is possible to prevent one number from being set with respect to the engine control modules of the plurality of outboard motors. As a result, it becomes possible to surely prevent situations where it becomes impossible to appropriately control the engine control modules (the outboard motors) due to setting of the same identification number.

According to the identification number setting apparatus and the identification number setting method for the outboard motors according to aspects of the embodiments of the present invention, even in a case where a plurality of outboard motors is attached to a ship body, it becomes possible to set identification numbers in the individual outboard motors without requiring complicated control of engine control modules.

DETAILED DESCRIPTION OF THE EMBODIMENTS

Hereinafter, an embodiment will be described in detail with reference to the accompanying drawings. Hereinafter, a case where a ship to which an apparatus for setting identification numbers of outboard motors according to the present embodiment (hereinafter also referred to as an "identification number setting apparatus") is applied is equipped with three outboard motors will be described. However, the number of outboard motors which are mounted on the ship to which the identification number setting apparatus according to the present embodiment is applied is not limited to three, and can be appropriately changed. For example, the identification number setting apparatus according to the present embodiment can be applied to ships equipped with two outboard motors or four or more outboard motors.

Figure 1:
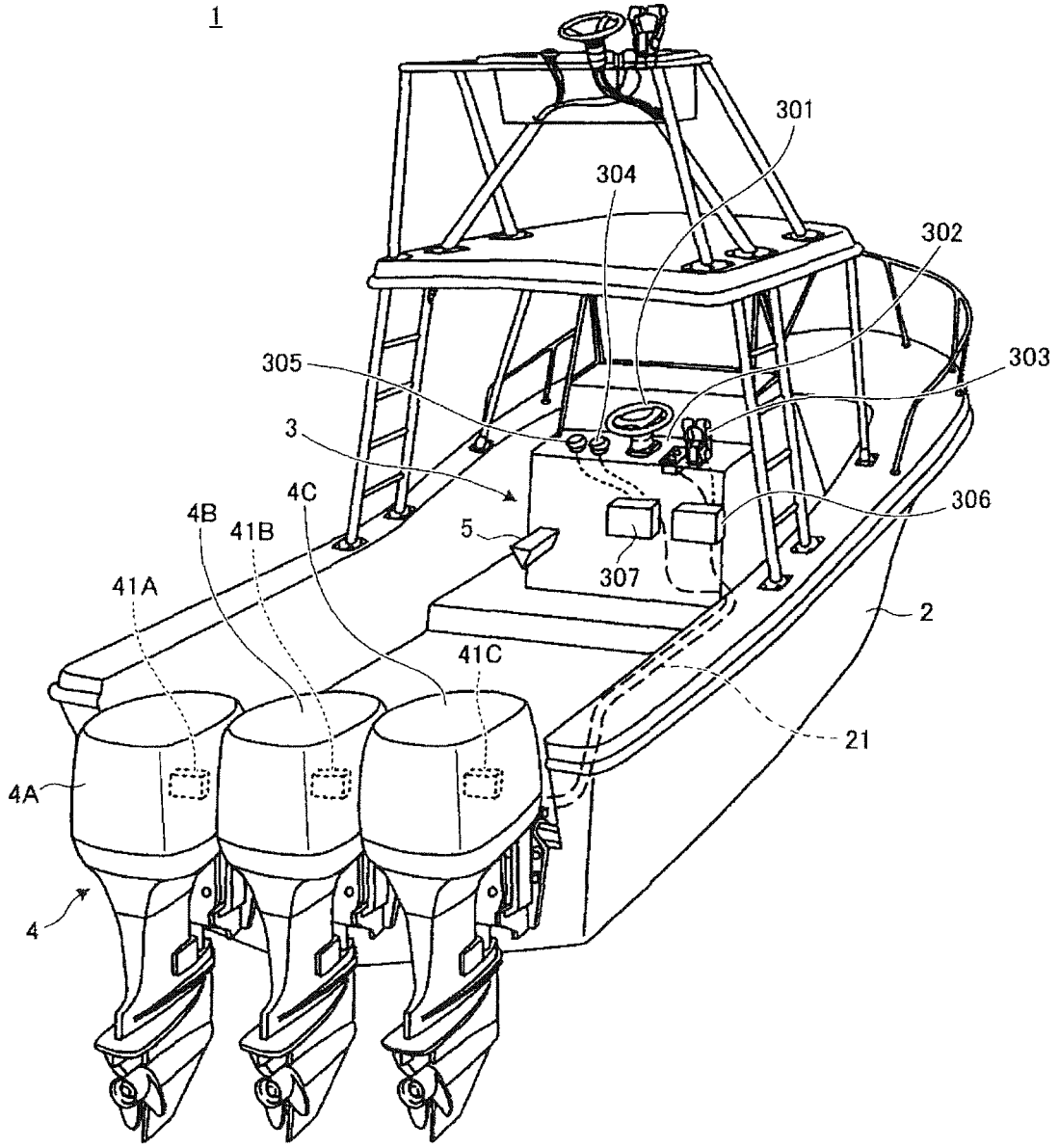
FIG. 1 is a perspective view illustrating an overall configuration of a ship to which an apparatus for setting identification numbers of outboard motors according to an embodiment is applied.

FIG. 1 is a perspective view illustrating an overall configuration of a ship to which the identification number setting apparatus according to the present embodiment is applied. FIG. 1 shows a ship equipped with an electronic control throttle system. The electronic control throttle system acquires the operation state of a mode control lever which receives an operation of a ship operator, by a sensor, and performs an electric process, thereby performing control to open or close a throttle valve.

Also, ships to which the identification number setting apparatus according to the present embodiment can be applied are not limited to ships equipped with electronic control throttle systems. For example, the identification number setting apparatus according to the present embodiment may be applied to a ship equipped with a mechanical control throttle system in which a remote control lever and a throttle valve are mechanically connected by a remote control cable. The mechanical control throttle system performs control to directly open or close the throttle valve through the remote control cable, in response to the operation state of the remote control lever. Also, the mechanical control throttle system switches a shift position to a forward, neutral, or reverse position through the remote control cable.

As shown in FIG. 1, a ship 1 is configured so as to include a ship body 2 which is made of aluminum, fiber reinforced plastics (FRP), or the like, a ship operating unit 3 which is installed at a position on the bow side slightly from the center of the ship body 2, and three outboard motors 4 (4A to 4C) which are attached to the stern of the ship body 2. The ship operating unit 3 is a part for receiving ship operating instructions issued with respect to the ship 1 by a ship operator. Each outboard motor 4 includes an engine and a propeller, and generates a propulsive force for the ship 1 in response to an operation of the ship operator.

At the center of the ship operating unit 3, a steering wheel 301 is provided so as to be turned by the ship operator to steer the ship. On the right side of the steering wheel 301 (the right side of the movement direction of the ship 1), an ignition switch 302 and a remote control lever (hereinafter, referred to as a "remote lever") 303 are installed. The ignition switch 302 is composed of, for example, a push switch, and receives an operation of the ship operator for starting the outboard motors 4. The remote lever 303 receives an operation of the ship operator for moving the ship 1 forward or backward.

Meanwhile, on the left side of the steering wheel 301 (the left side of the movement direction of the ship 1), an emergency power supply key switch 304 and an emergency stop switch 305 are installed. The emergency power supply key switch 304 is a switch for instructing supply of electric power to engine control modules (hereinafter, referred to as "ECMs") 41 of the outboard motors 4 (to be described below) in an emergency, for example, in a case where an ignition key is lost. The emergency stop switch 305 is a switch for instructing stop of driving of the outboard motors 4 in an emergency. Also, in FIG. 1, both of the emergency power supply key switch 304 and the emergency stop switch 305 are shown as being capable of being pushed by the ship operator; however, the present invention is not limited thereto. Also, the ignition switch 302 and the emergency power supply key switch 304 may be configured as one body.

Also, in the ship operating unit 3, a boat control module (hereinafter, referred to as a "BCM") 306 and a keyless controller 307 are installed. The BCM 306 controls the ECMs 41 of the outboard motors 4 (to be described below) in response to an operation on the remote lever 303. The keyless controller 307 is a part for performing main control of a keyless entry system. This keyless entry system enables the ship operator to start the outboard motors 4 by operating the ignition SW 302 and the like without inserting a mechanical key into a key cylinder.

For example, the keyless controller 307 performs an authentication process between the keyless controller and a portable device 5 which the ship operator carries, and an authentication process between the keyless controller and the ECMs 41 of the outboard motors 4 (to be described below). Also, the keyless controller 307 allows electric power to be supplied to the ECMs 41, in response to the results of those authentication processes. Further, the keyless controller 307 sets identification numbers in the ECMs 41 during initial identification number registration for the authentication process between the keyless controller and the ECMs 41.

The three outboard motors 4A to 4C include the ECMs 41 (41A to 41C) for controlling engines included in the outboard motors, respectively. The ECMs 41 (41A to 41C) control the internal engines of the outboard motors 4A to 4C, respectively, for example, in response to signals from the BCM 306 or the keyless controller 307 connected to the ECMs through a controller area network (CAN) 21 provided in the ship body 2.

The portable device 5 constitutes a so-called smart key. While being on the ship 1, the ship operator carries the portable device 5, and thus can perform starting of the outboard motors 4 and the like without using the mechanical key. The portable device 5 is equipped with a transmitter. This transmitter transmits an electric wave to be used in an authentication process with the keyless controller 307. Also, the portable device 5 may be configured so as to include the ignition key as a part.

In the ship 1 equipped with the plurality of outboard motors 4A to 4C on the ship body 2 as shown in FIG. 1, in order to appropriately control the internal engines of the outboard motors, it is necessary to identify the individual outboard motors 4. The identification number setting apparatus according to the present embodiment is for setting identification numbers in the individual outboard motors 4 (more specifically, the ECMs 41 of the individual outboard motors 4) in order to identify the individual outboard motors 4.

Figure 2:
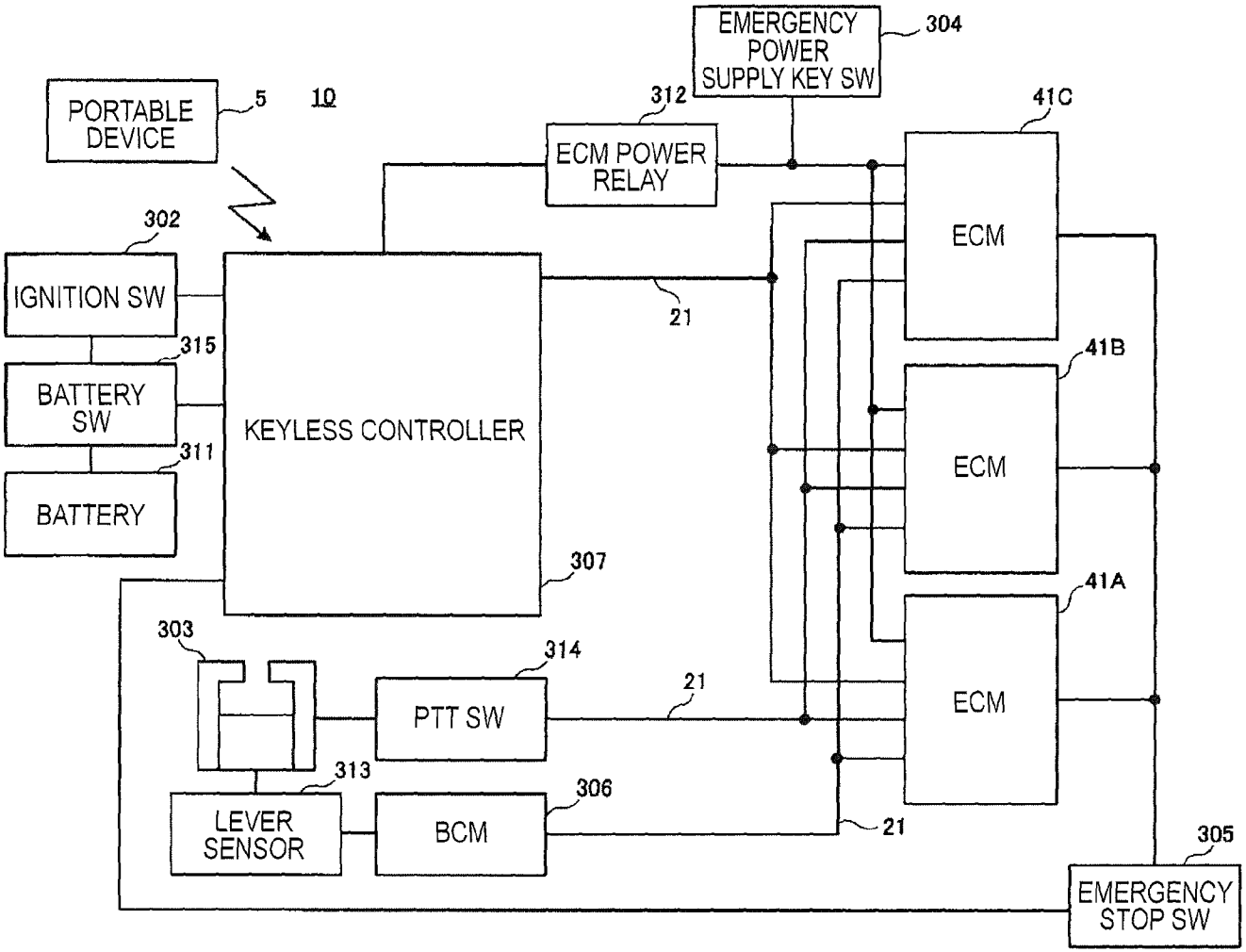
FIG. 2 is a view for explaining a configuration of the apparatus for setting identification numbers of outboard motors according to the embodiment.

Hereinafter, a configuration example of the identification number setting apparatus according to the present embodiment will be described with reference to FIG. 2. FIG. 2 is a view for explaining the configuration of the identification number setting apparatus according to the present embodiment. Also, in FIG. 2, for convenience of explanation, the outboard motors 4 and some constituent elements such as the engines included in the outboard motors 4 are not shown. Also, in FIG. 2, the common constituent elements to FIG. 1 are denoted by the same reference symbols, and repetitive descriptions thereof will be appropriately omitted.

As shown in FIG. 2, an identification number setting apparatus 10 is configured so as to include the plurality of ECMs 41A to 41C, and the keyless controller 307 which is connected to the plurality of ECMs 41A to 41C through the CAN 21. The keyless controller 307 is connected to all ECMs 41A to 41C, and can perform communication with each of the ECMs 41A to 41C.

The keyless controller 307 is connected to a battery 311 through the ignition switch (SW) 302 and a battery switch (SW) 315. For example, if the ship operator carrying the portable device 5 turns on the battery SW 315, electric power is supplied from the battery 311 to the keyless controller 307.

Between the keyless controller 307 and the ECMs 41A to 41C, an ECM power relay 312 is connected. In response to an instruction from the keyless controller 307, the ECM power relay 312 receives electric power supplied from a battery (not shown), thereby being switched from an open state to a connection state.

Also, between the ECM power relay 312 and the ECMs 41A to 41C, the above described emergency power supply key switch (SW) 304 is connected. Even in a situation where electric power is not being supplied through the ECM power relay 312, the emergency power supply key SW 304 supplies electric power from a battery (not shown) to the ECMs 41A to 41C if being pushed by the ship operator.

Further, the keyless controller 307 is connected to the emergency stop switch (SW) 305. The emergency stop SW 305 is connected to all of the ECMs 41A to 41C. If the emergency stop SW 305 is operated, the ECMs 41A to 41C stop the engines.

The remote lever 303 is connected to a lever sensor 313. The lever sensor 313 detects the position of the remote lever 303. A signal detected by the lever sensor 313 (a lever sensor signal) is output to the BCM 306. This lever sensor signal is used for control of the BCM 306 on the ECMs 41A to 41C.

Also, in the remote lever 303, a power trim tilt switch (PTT SW) 314 is provided. The PTT SW 314 receives a pushing operation of the ship operator for adjusting the angles of the plurality of outboard motors 4 to the ship body 2. A signal according to the operation on the PTT SW 314 (a PTT SW signal) is output to the ECMs 41A to 41C, and is used in the ECMs 41A to 41C to adjust the angles of the outboard motors 4.

In the ship 1 according to the present embodiment, under control of the keyless controller 307, the keyless entry system is operated. This keyless entry system is for making starting of the outboard motors 4A to 4C (the ECMs 41A to 41C) and the like possible according to the authentication result of an authentication process of collating authentication numbers registered in advance in the portable device 5 and the ECMs 41 and authentication numbers registered in the keyless controller 307.

An identification number setting operation of the identification number setting apparatus 10 according to the present embodiment is performed during initial registration of authentication information for an authentication process in keyless control of the keyless controller 307. Here, prior to an initial registration operation of the authentication information, an outline of an operation of the keyless entry system under control of the keyless controller 307 will be described. Hereinafter, a case of using authentication numbers as the authentication information will be described.

If the ship operator turns on the ignition SW 302 with the portable device 5 carried, the keyless entry system is driven. If the keyless entry system is driven, first, the keyless controller 307 performs an authentication process between the keyless controller and the portable device 5 (a first authentication process). In this first authentication process, authentication numbers registered in advance in the portable device 5 and the keyless controller 307 are collated.

In a case where the authentication result of the first authentication process is "OK", the keyless controller 307 switches the ECM power relay 312 to the connection state, thereby supplying electric power to the ECMs 41A to 41C. Next, the keyless controller 307 performs an authentication process between the keyless controller and the ECMs 41A to 41C (a second authentication process). In this second authentication process, similarly in the first authentication process, authentication numbers registered in advance in the keyless controller 307 and the ECMs 41A to 41C are collated.

In a case where the authentication result of the second authentication process is "OK", the ECMs 41A to 41C become able to control the engines included in the outboard motors 4A to 4C. More specifically, the ECMs 41A to 41C control start or stop of the engines, fuel injection of fuel injectors, ignition of ignition plugs, or shifts, in response to control signals from the BCM 306 (more specifically, control signals according to the operation state on the remote lever 303).

Hereinafter, the initial registration operation of the authentication numbers (more specifically, the authentication numbers of the portable device 5 and the ECMs 41) for the authentication process in keyless control as described above will be described. It is assumed that, before the initial registration operation is performed, all of the authentication numbers of the portable device 5 and the ECMs 41 are unregistered. Also, it is assumed that the ship body 2 is equipped with three outboard motors 4A to 4C arranged from the left side of the movement direction of the ship 1 toward the right side.

If the ship operator turns on the ignition SW 302 with the portable device 5 carried, the keyless controller 307 requests the authentication number from the portable device 5. If the authentication number is received from the portable device 5, the keyless controller 307 performs initial registration of the received authentication number as the authentication number of the portable device 5. After the initial registration of the portable device 5 is completed, the keyless controller 307 switches the ECM power relay 312 to the connection state, thereby supplying electric power to the ECMs 41A to 41C. As a result, the ECMs 41A to 41C become operable.

Then, the keyless controller 307 performs initial registration of the authentication numbers of the ECMs 41. The initial registration of the authentication numbers of the ECMs 41 is performed in the order of the ECM 41A of the outboard motor 4A arranged on the left side of the movement direction of the ship body 2, the ECM 41B of the outboard motor 4B arranged at the center, and the ECM 41C of the outboard motor 4C arranged on the right side. Also, before the initial registration of the authentication numbers of the ECMs 41 (in other words, before setting of identification numbers), "0" is registered as an identification number in each ECM 41.

Figure 3:
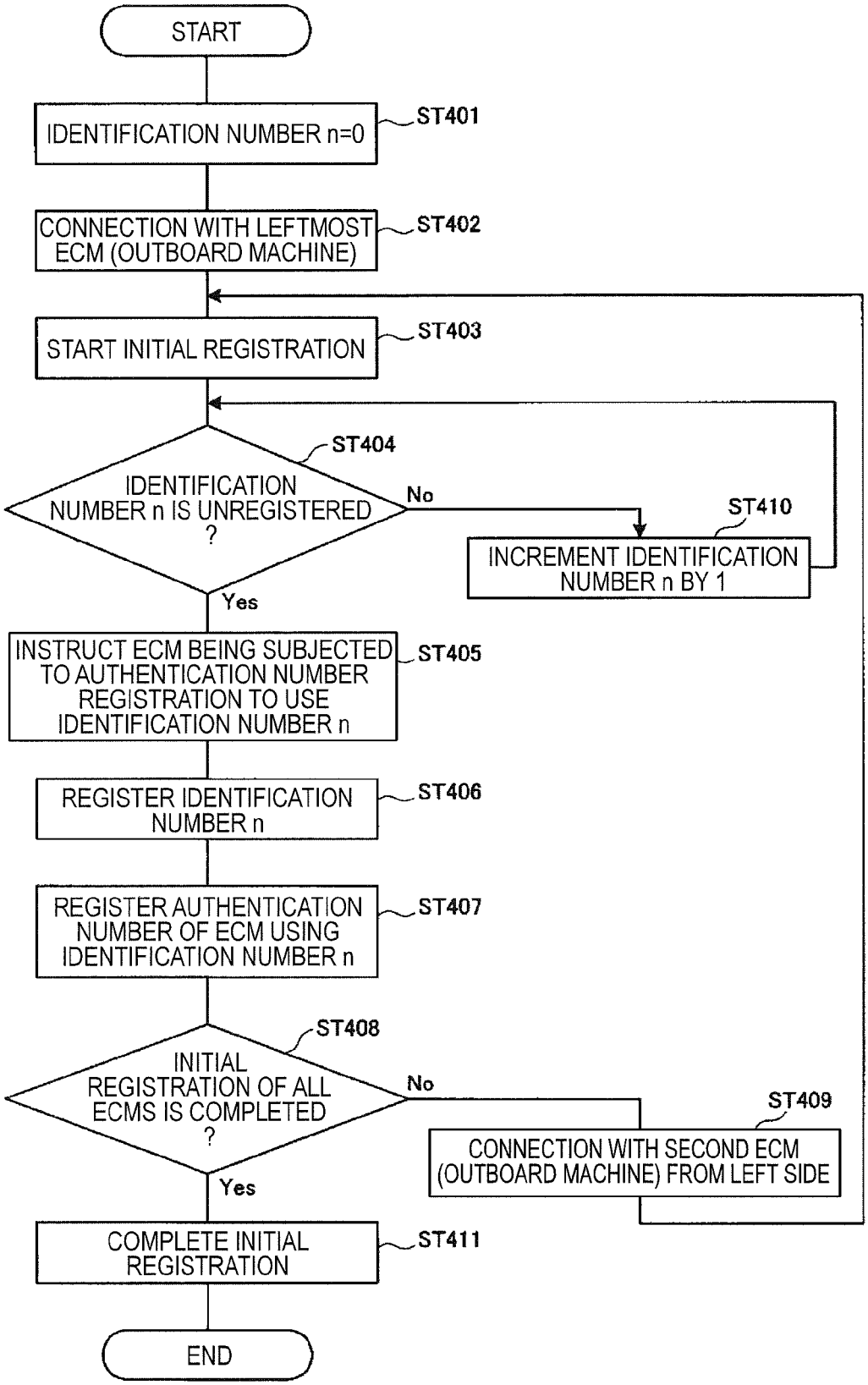
FIG. 3 is a flow chart for explaining an initial registration operation of identification numbers of engine control modules in the ship to which the apparatus for setting identification numbers of outboard motors according to the embodiment is applied.

FIG. 3 is a flow chart for explaining an initial registration operation of the authentication numbers of the ECMs 41 in the ship 1 to which the identification number setting apparatus 10 according to the present embodiment is applied. As shown in FIG. 3, in a case of performing initial registration of the authentication numbers of the ECMs 41, in step 401, the keyless controller 307 initializes an identification number "n". Due to the initialization of the identification number "n", the identification number "n" is set to "0".

After the identification number "n" is initialized, in step 402, when the operator connects the ECM 41A of the leftmost outboard motor 4A to the keyless controller 307, the keyless controller 307 requests the authentication number from the ECM 41A. Then, if the authentication number is received from the ECM 41A, in step 403, the keyless controller 307 starts initial registration of the ECM 41A. In this initial registration, in step 404, the keyless controller 307 determines whether the identification number "n" (=0) is unregistered. Here, since all of the identification numbers of the ECMs 41 are unregistered ("Yes" in step 404), the process proceeds to step 405.

In step 405, the keyless controller 307 instructs the ECM 41A being subjected to authentication number registration (initial registration) to use "n" (=0) as its identification number. Then, in step 406, the keyless controller 307 registers the identification number "n" (=0) as the identification number of the ECM 41A. Thereafter, in step 407, the keyless controller 307 registers the received authentication number for the ECM 41A using the identification number "n" (=0).

After registration of the identification number and authentication number of the ECM 41A is completed as described above, in step 408, the keyless controller 307 determines whether initial registration of all ECMs 41 has been completed. Here, since initial registration of the ECMs 41B and 41C of the outboard motors 4B and 4C has not been completed ("No" in step 408), the process proceeds to step 409.

In step 409, when the operator connects the ECM 41B of the second-leftmost outboard motor 4B (that is, the central one of the three outboard motors 4A to 4C) to the keyless controller 307, the keyless controller 307 requests the authentication number from the ECM 41B. Then, the keyless controller 307 returns the process to step 403, and performs the processes of step 403 and the subsequent steps again. In this case, in step 404, it is determined that the identification number "n" (=0) is already registered ("No" in step 404). Therefore, in step 410, the keyless controller 307 increments the value of the identification number "n". As a result, the identification number "n" is set to "n+1" (=1).

Thereafter, the keyless controller 307 performs steps 404 to 408 using that identification number "n" (=1). That is, the keyless controller 307 instructs the ECM 41B to use "n" (=1) as its identification number while registering the identification number "n" (=1) as the identification number of the ECM 41B, and registers the authentication number received from the ECM 41B. Also, since it is determined in step 408 that initial registration of the ECM 41C of the outboard motor 4C has not been completed ("No" in step 408), the process proceeds to step 409.

In step 409, when the operator connects the ECM 41C of the third-leftmost outboard motor 4C (that is, the rightmost one of the three outboard motors 4A to 4C) to the keyless controller 307, the keyless controller 307 requests the authentication number from the ECM 41C. Then, the keyless controller 307 returns the process to step 403, and performs the processes of step 403 and the subsequent steps again. In this case, in step 404, it is determined that the identification number "n" (=1) is already registered ("No" in step 404). Therefore, in step 410, the keyless controller 307 increments the value of the identification number "n". As a result, the current identification number "n" is set to "n+1" (=2).

Thereafter, the keyless controller 307 performs steps 404 to 408 using that identification number "n" (=2). That is, the keyless controller 307 instructs the ECM 41C to use "n" (=2) as its identification number while registering the identification number "n" (=2) as the identification number of the ECM 41C, and registers the authentication number received from the ECM 41C.

If initial registration of the ECM 41C is completed, the keyless controller 307 determines that initial registration of all ECMs 41 has been completed ("Yes" in step 408). In this case, the keyless controller 307 completes initial registration of the ECMs 41 in step 411, and finishes the process. When performing initial registration of the authentication numbers of the ECMs 41 as described above, the keyless controller 307 sets the identification numbers for the ECMs 41.

After the identification numbers are set as described above, the ECMs 41A to 41C transmit the identification numbers together with the authentication numbers by communication through the CAN 21. By receiving the identification numbers, the BCM 306 or the keyless controller 307 can identify the individual ECMs 41 (the outboard motors 4) and appropriately control the engines of the individual outboard motors 4.

As described above, in the identification number setting apparatus 10 according to the present embodiment, the keyless controller 307 for performing the authentication process for keyless control between the keyless controller and the plurality of ECMs 41 sets the identification numbers in the plurality of ECMs 41A to 41C during initial registration of the authentication information (the authentication numbers) for the authentication process. Therefore, it is possible to practically omit control of the ECMs 41 for setting identification numbers. As a result, even in a case where the plurality of outboard motors 4 is attached to the ship body 2, it becomes possible to set the identification numbers in the individual outboard motors 4 without requiring complicated control in the ECMs 41. Also, it is possible to reduce the cost for developing the ECMs 41, and it becomes possible to reduce the manufacturing cost of an entire outboard motor 4.

Also, the keyless controller 307 sets the identification numbers in the plurality of ECMs 41A to 41C in a predetermined order according to arrangement of the plurality of outboard motors 4A to 4C on the ship body 2. Therefore, it is possible to set the identification numbers according to the positions of the outboard motors 4A to 4C on the ship body 2, in the ECMs 41A to 41C. As a result, it becomes possible to appropriately control the plurality of outboard motors 4A to 4C using the position information of the outboard motors 4 according to the identification numbers.

Especially, the keyless controller 307 sets a minimum value different from the identification number of an ECM 41 (for example, the ECM 41A) previously set, as the identification number of a subsequent ECM 41 (for example, the ECM 41B). Therefore, it is possible to prevent one number from being set with respect to the ECMs 41A to 41C of the plurality of outboard motors 4A to 4C. As a result, it becomes possible to surely prevent situations where it becomes impossible to appropriately control the ECMs 41 (the outboard motors 4) due to setting of the same identification number.

Also, in the ship 1 equipped with the plurality of outboard motors 4, in a case where the positions of the outboard motors 4 on the ship body 2 are switched, or in a case where an outboard motor 4 is replaced due to a breakdown or the like, the position information of the individual outboard motors 4 and the identification numbers of the ECMs 41 may not correspond to each other. Even in this case, the keyless controller 307 can perform initial registration of authentication information again in response to an instruction of the ship operator, whereby it becomes possible to associate the position information of the outboard motors 4 and the identification numbers with each other.

Also, the present invention is not limited to the embodiment mentioned above and can be modified and implemented in various forms. With respect to the contents of the processes and determinations of the embodiment shown in the accompanying drawings, the present invention is not limited thereto and can be appropriately modified as long as the modifications exhibit the effects of the present invention. In addition, the invention can be appropriately modified and implemented without departing from the scope of the object of the invention.

For example, in the embodiment, on the premise that the outboard motors 4A to 4C are attached from the left side of the movement direction of the ship 1, a case of sequentially setting identification numbers in the individual ECMs 41A to 41C has been described. However, the order to set the identification numbers in the ECMs 41A to 41C is not limited thereto, and can be appropriately changed. On the premise that the keyless controller 307 can grasp the position information of the outboard motors 4A to 4C (the ECMs 41A to 41C) on the ship body 2, it is possible to set the identification number setting order to an arbitrary setting order.

Also, in the embodiment, a case of setting different identification numbers in the ECMs 41A to 41C of the outboard motors 4A to 4C has been described. However, the identification numbers which are set in the ECMs 41A to 41C are not limited thereto, and can be appropriately changed. For example, with respect to some ECMs 41 which are included in the plurality of ECMs 41 and are always subjected to the same control, a common identification number may be set.

As described above, the present invention has an effect that it is possible to set an identification number for each outboard motor without requiring complicated control of ECMs even in a case where a plurality of outboard motors is attached to the body of a ship, and is useful, for example, in a ship equipped with a plurality of outboard motors.

What is claimed is:

1. An identification number setting apparatus of a plurality of outboard motors attached to a ship body, comprising:

a plurality of engine control modules provided in the plurality of outboard motors; and a keyless controller configured to perform an authentication process for keyless control between the keyless controller and the plurality of engine control modules, wherein during initial registration of authentication information for the authentication process, the keyless controller sets identification numbers in the plurality of engine control modules, and wherein the authentication information is authentication numbers respectively registered in the keyless controller and each of the engine control modules, the identification numbers are different for each of the plurality of engine control modules, and the authentication numbers are different for each of the plurality of engine control modules.

2. The identification number setting apparatus of a plurality of outboard motors according to claim 1, wherein the keyless controller sets the identification numbers in the plurality of engine control modules in a predetermined order according to arrangement of the plurality of outboard motors on the ship body.

3. The identification number setting apparatus of a plurality of outboard motors according to claim 2, wherein the keyless controller sets a minimum value different from the identification number of an engine control module previously set, as the identification number of a subsequent engine control module.

4. An identification number setting method of a plurality of outboard motors attached to a ship body which includes a plurality of engine control modules and a keyless controller configured to perform an authentication process for keyless control between the keyless controller and the plurality of engine control modules, the identification number setting method comprising:

performing initial registration of authentication information for the authentication process by the keyless controller, wherein the authentication information is authentication numbers respectively registered in the keyless controller and each of the engine control modules, wherein the authentication numbers are different for each of the plurality of engine control modules; and setting identification numbers in the plurality of engine control modules during the initial registration, wherein the identification numbers are different for each of the plurality of engine control modules.

5. The identification number setting method of a plurality of outboard motors according to claim 4, wherein the identification numbers are set in the plurality of engine control modules in a predetermined order according to arrangement of the plurality of outboard motors on the ship body.

6. The identification number setting method of a plurality of outboard motors according to claim 5, wherein a minimum value different from the identification number of an engine control module previously set is set as the identification number of a subsequent engine control module.

* * * * *